United States Patent [19]

Waldrop

[11] 4,085,561

[45] Apr. 25, 1978

[54] METHOD AND APPARATUS FOR DEPOSITING PACKAGES OF SOFT-PACK GOODS IN A BOX

[76] Inventor: Marless Wayne Waldrop, 9933 Harwin Dr., Houston, Tex. 77036

[21] Appl. No.: 761,211

[22] Filed: Jan. 21, 1977

[51] Int. Cl.[2] ..... B65B 35/58

[52] U.S. Cl. ..... 53/35; 53/143; 53/161; 53/244; 214/6 DK

[58] Field of Search ..... 53/35, 143, 161, 244, 53/250; 198/403, 409; 214/6 DK

[56] References Cited

U.S. PATENT DOCUMENTS

| | | | |
|---|---|---|---|
| 3,443,355 | 5/1969 | Birrell | 53/143 X |
| 3,694,993 | 10/1972 | East | 53/35 X |

*Primary Examiner*—Travis S. McGehee

[57] ABSTRACT

A method and apparatus to deposit packages of soft-pack goods in a face-up, end-to-end arrangement in a box. A discharge apparatus deposits successive packages in the box by flipping the packages through substantially 180° about the ends of the packages.

9 Claims, 16 Drawing Figures

Fig. 6
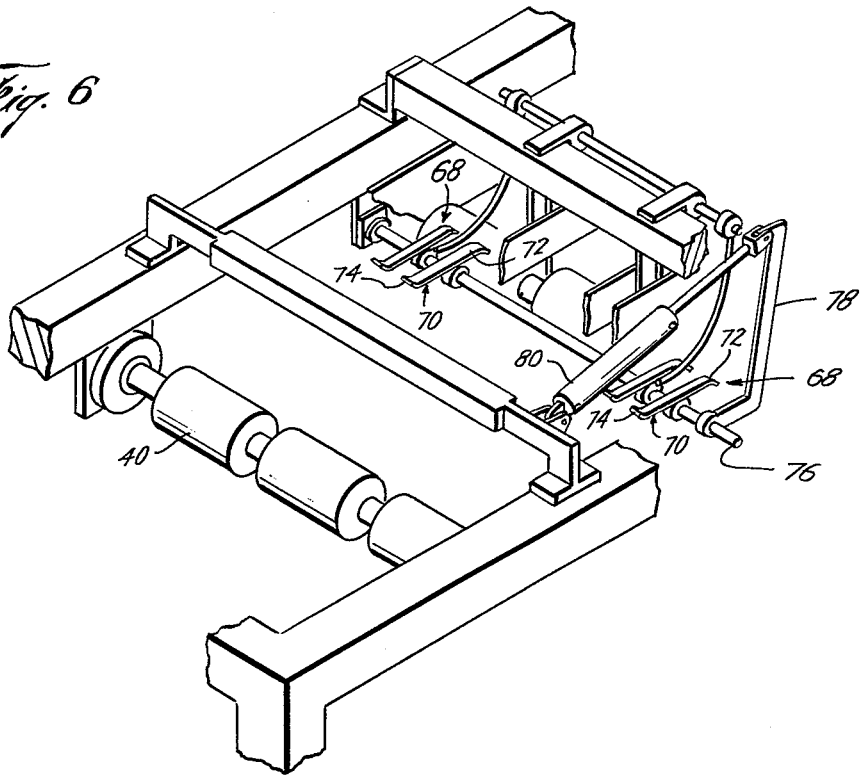
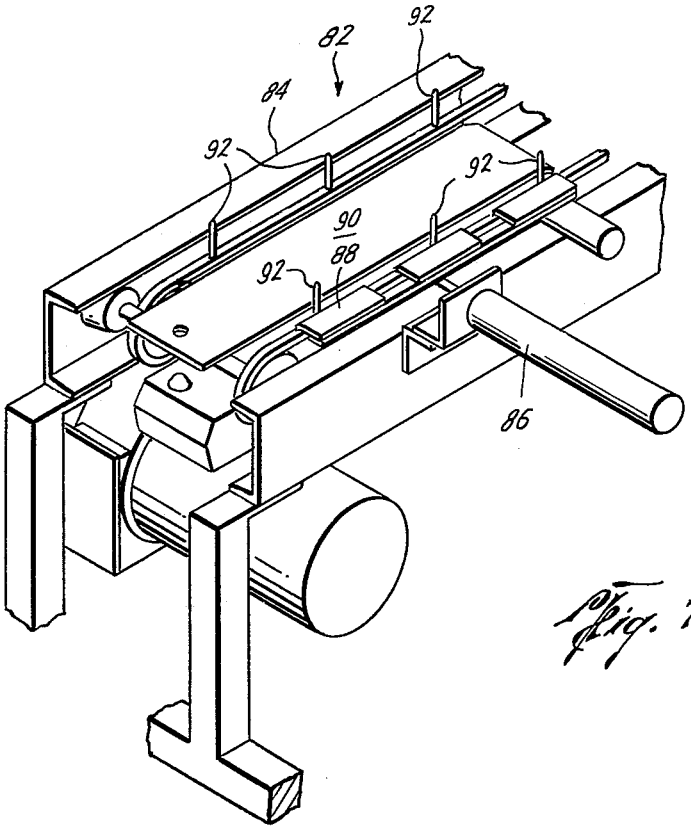
Fig. 7

Fig. 10
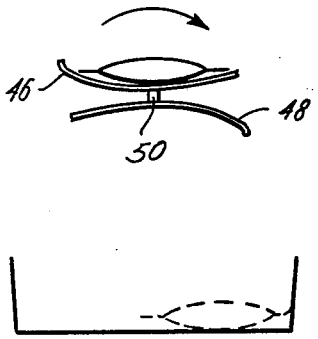
Fig. 11
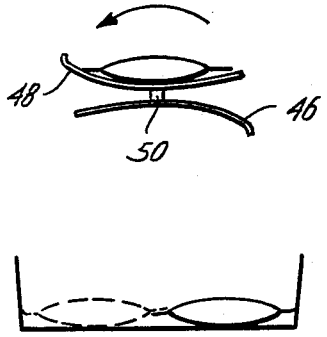
Fig. 12
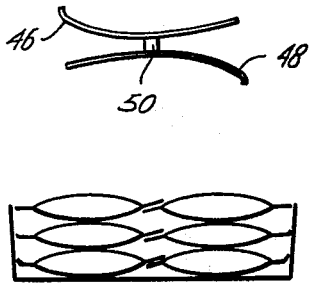
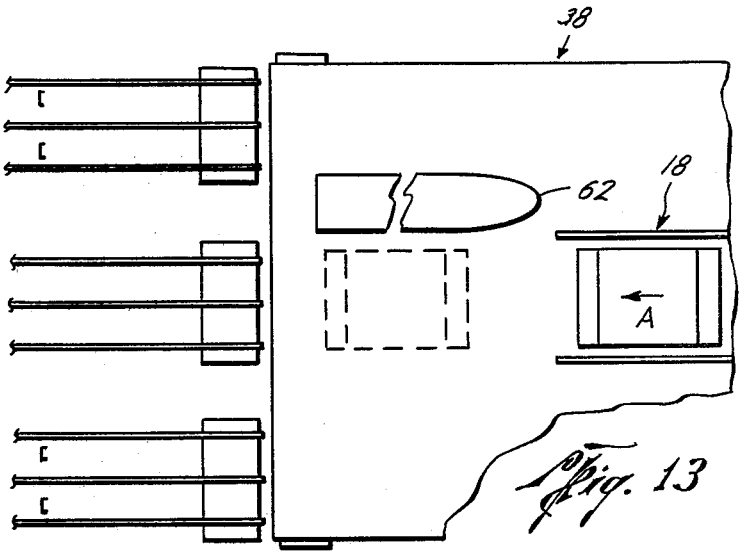
Fig. 13
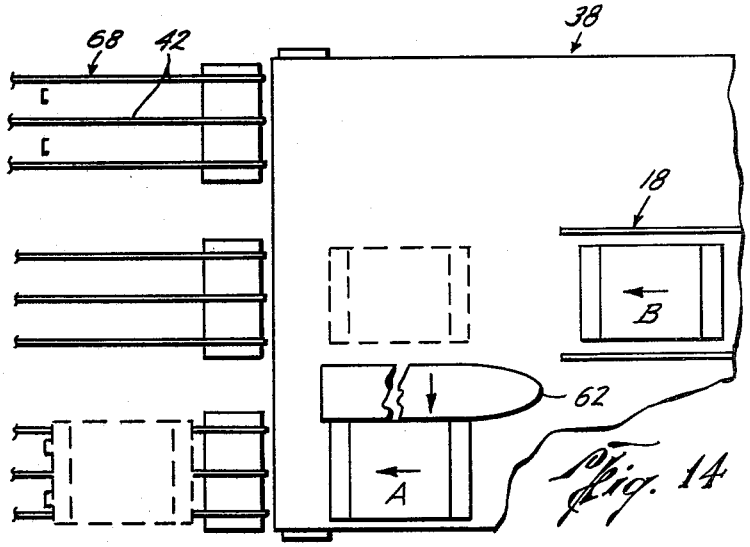
Fig. 14
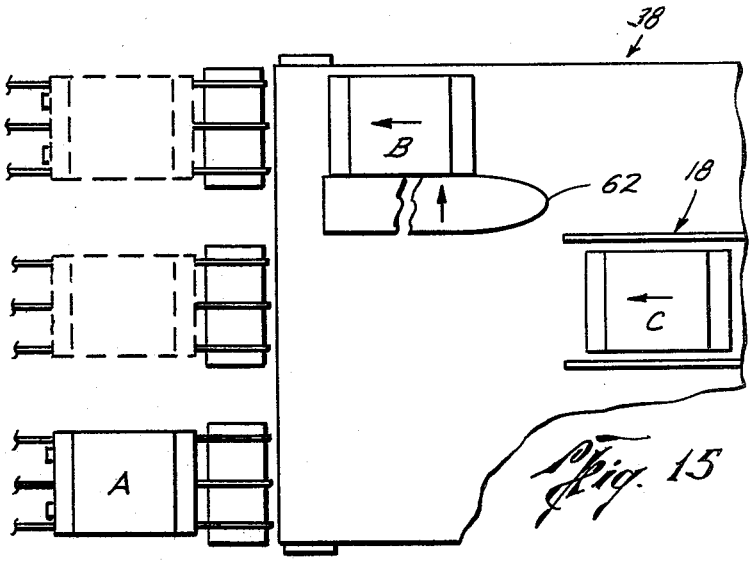
Fig. 15

METHOD AND APPARATUS FOR DEPOSITING PACKAGES OF SOFT-PACK GOODS IN A BOX

BACKGROUND AND SUMMARY OF THE INVENTION

Potato chips or like goods are normally packaged in plastic or wax paper bags (soft-pack goods). These packages are generally made from solid sheets of plastic, which are sealed at the ends about the goods and lengthwise along the seam joining the end edges of the sheet as the bags are filled. The packages are then carried by a conveyor to a location for hand packing in a box. Each package inherently falls onto the conveyor in a position in which the seam faces upwardly and identifying indicia faces downwardly. Consequently, the packages must be inverted from face down to face up positions before being deposited in the box.

It is conventional practice to arrange the packages in two stacks with the packages in more or less end-to-end relation within the box, each stack ordinarily consisting of two or more layers. Heretofore, the packages of soft-pack goods have been inverted and then stacked by hand, which is a time-comsuming and expensive procedure.

It is therefore the primary object of this invention to provide a method and apparatus for automatically inverting and arranging soft-pack goods in two stacks within a box.

If it is desired to permit more than one box to be filled at a time for a high volume of work, the box packing machine does not have to be entirely duplicated. Rather, the above-mentioned apparatus for inverting and stacking the packages may be duplicated for each successive package along separate lines of travel by rearranging the single line of packages into two or more lines of side-by-side bags prior to delivery of the bags at the inverting and stacking station.

It is therefore another object of this invention to provide a simple and inexpensive method and apparatus for so rearranging a single line of successive packages automatically in response to their travel along the conveyor, and preferably rearranging the single line into three lines.

A further object is to provide a method and apparatus in which the successive packages from a plurality of lines are inverted and stacked into their respective boxes in unison with one another, and thus with a minimum of duplication of operating parts.

A still further object is to provide a method and apparatus having a simplified arrangement for moving one or more boxes into mounting positions for filling and then into successive mounting positions for additional preparation prior to wrapping of the boxes.

In accordance with the illustrated embodiment of the invention, these and other objects are accomplished by means of method and apparatus in which conveying means is provided for moving the packages in a line of successive packages with all packages facing up or down. A support means is arranged for singly receiving successive ones of the packages from the conveying means. The support means is rotated approximately 180° in opposite directions when successive packages are received thereon so as to invert and permit alternate ones of said packages to fall onto two respective stack sites in the box. More particularly, the method contemplates and the apparatus makes it possible to continue to singly receive successive ones of the packages on the support means and to alternatively rotate the support means in opposite directions to invert and stack additional packages one above the other at each stack site.

Preferably, the support means has support surfaces on its opposite sites, so that the first package is received on one of the support surfaces in a first rotative position of the support means, the second package is received on the other support surface in a second rotative position of the support means, and the support means is rotatable between such first and second rotative positions. More particularly, the support means is preferably rotated about an axis transverse to the line of movement of the packages.

When two or more boxes are to be filled with packages, means are also provided for shifting one package of the first-mentioned line laterally into a second line of movement, and braking the movement of the one package until a successive package in the first-mentioned line has moved into a position to one side of the one package, whereby successive side-by-side packages in the two lines may be singly received by side-by-side portions of the support means, so that such portions may be operated simultaneously for depositing two stacks of packages into each of side-by-side positions beneath the support means.

It is also preferred that empty boxes be moved on a conveyor in a line transverse to the line of successive packages so as to sequentially dispose successive boxes on one side of the box to be filled, and the unfilled box is pushed, when so disposed, into a filling position beneath the support means. When it is so pushed, the unfilled box engages the filled box beneath the support means to move it to a position in which the packages stacked therein may be dressed. The preferred method and apparatus further contemplates that the packages in a filled box may be dressed by suitable means when disposed in the position for same, the dressed box being engaged by the filled box to move it to another station as the filled box is moved by the empty box into a position for dressing.

In accordance with the invention, a method and apparatus for depositing packages of soft-pack goods in a selected arrangement in a box is provided. The apparatus includes a conveying means and the method has a step for moving successive packages in a line with all of the packages facing up or down. Support means singly receives successive ones of the packages. The support means is alternatively rotated through 180° in opposite directions to flip the packages onto two respective stack sites in the box thereby inverting the packages while depositing them in the box.

BRIEF DESCRIPTION OF THE DRAWINGS

Other objects and advantages of the invention will become apparent upon reading the following detailed description and upon reference to the drawings, in which:

FIG. 6 is an enlarged perspective view of the gating mechanism of the apparatus illustrated in FIG. 1.

FIG. 7 is an enlarged perspective view of the ram assembly used to move boxes relative to the discharge station illustrated in FIG. 4.

FIGS. 10–12 are schematic representations of the steps used in depositing packages in a single box.

FIGS. 13–15 are schematic representations of packages being shuttled from a single line of travel into multiple lines of travel.

While the invention will be described in connection with a preferred embodiment and procedure, it will be understood that it is not intended to limit the invention to that embodiment and procedure. On the contrary, it is intended to cover all alternatives, modifications and equivalents as may be included within the spirit and the scope of the invention as defined by the appended claims.

DETAILED DESCRIPTION OF THE INVENTION

Figures 1A, 1B:
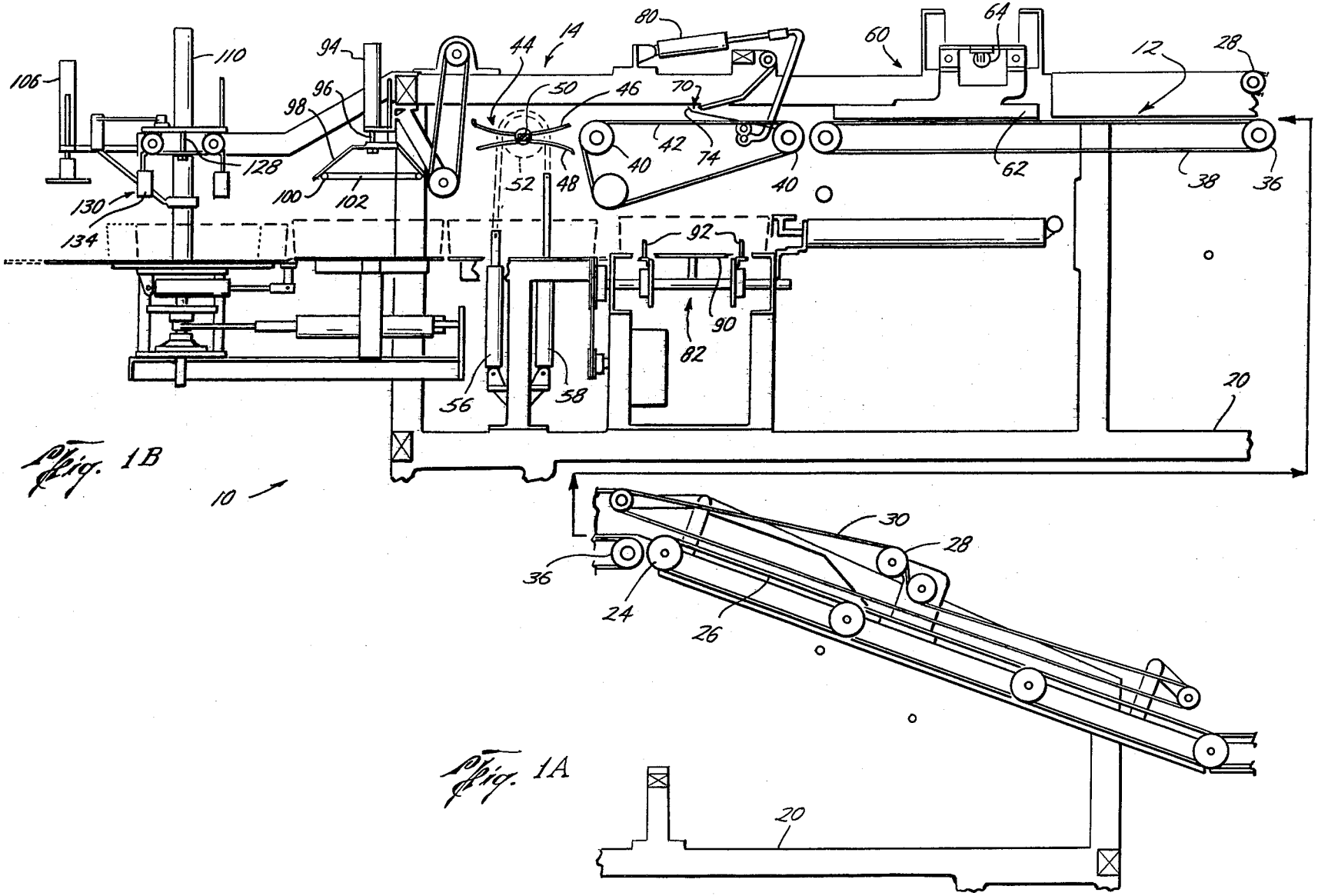
FIGS. 1A and 1B are elevational cross-sectional views of am embodiment of the apparatus constructed according to the present invention.

Turning first to FIGS. 1A and 1B, an embodiment of an automatic boxing apparatus constructed according to the present invention is generally designated with the numeral 10. Boxing apparatus 10 is generally constructed of a conveyor 12, discharge apparatus 14 and control apparatus 16 (See FIG. 5). Conveyor 12 movably carries packages of soft-pack goods successively along at least one line of travel. Discharge apparatus 14 deposits the packages of soft-pack goods in the box shown in dotted outline. Control means 16 coordinates the action of discharge apparatus 14 with the movement of the packages along conveyor 12 for depositing the packages in the box in a selected arrangement.

Figure 2:
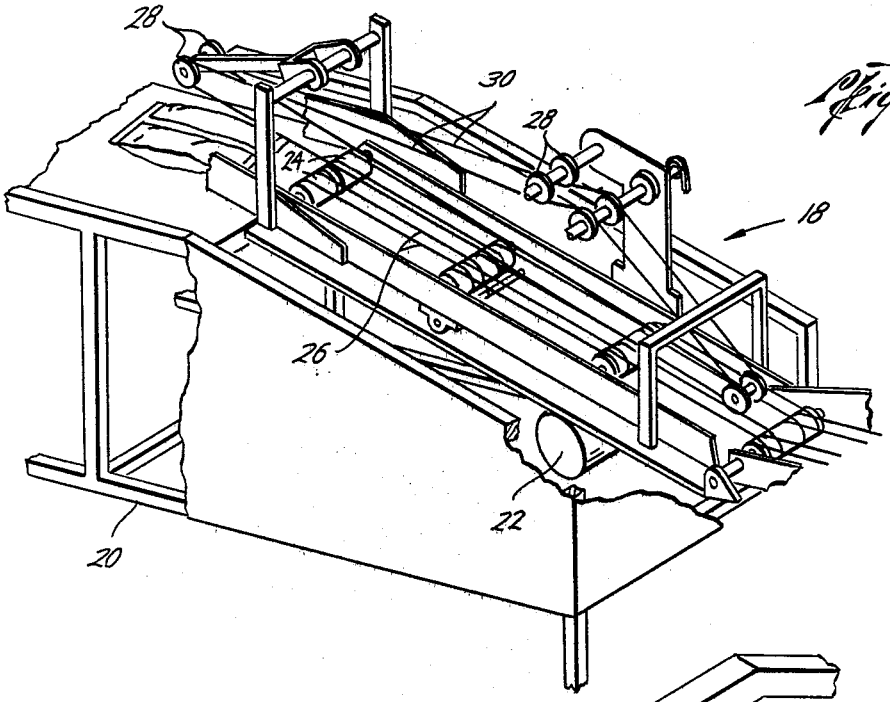
FIG. 2 is a perspective view of the in-put conveyor illustrated in FIG. 1.

Although the packages may be carried to boxing apparatus 10 by any convenient apparatus, a conveying apparatus 18, such as illustrated in FIG. 2, is preferred. Conveyor 18 is generally constructed of framework 20 which supports a motor 22 for driving the belts, a first set of pulleys 24 with a multiplicity of endless O-ring belts 26 disposed thereabout and a second set of pulleys 28 with a multiplicity of endless O-ring belts 26 disposed thereabout. Second set of pulleys 28 and belts 30 are disposed above first set of pulleys 24 and belts 26 to provide sufficient force against the packages to insure the movement of the packages along belts 26 and onto a second conveying portion 32. Preferably, belt 26 has a velocity of 285 feet per minute.

Figure 3:
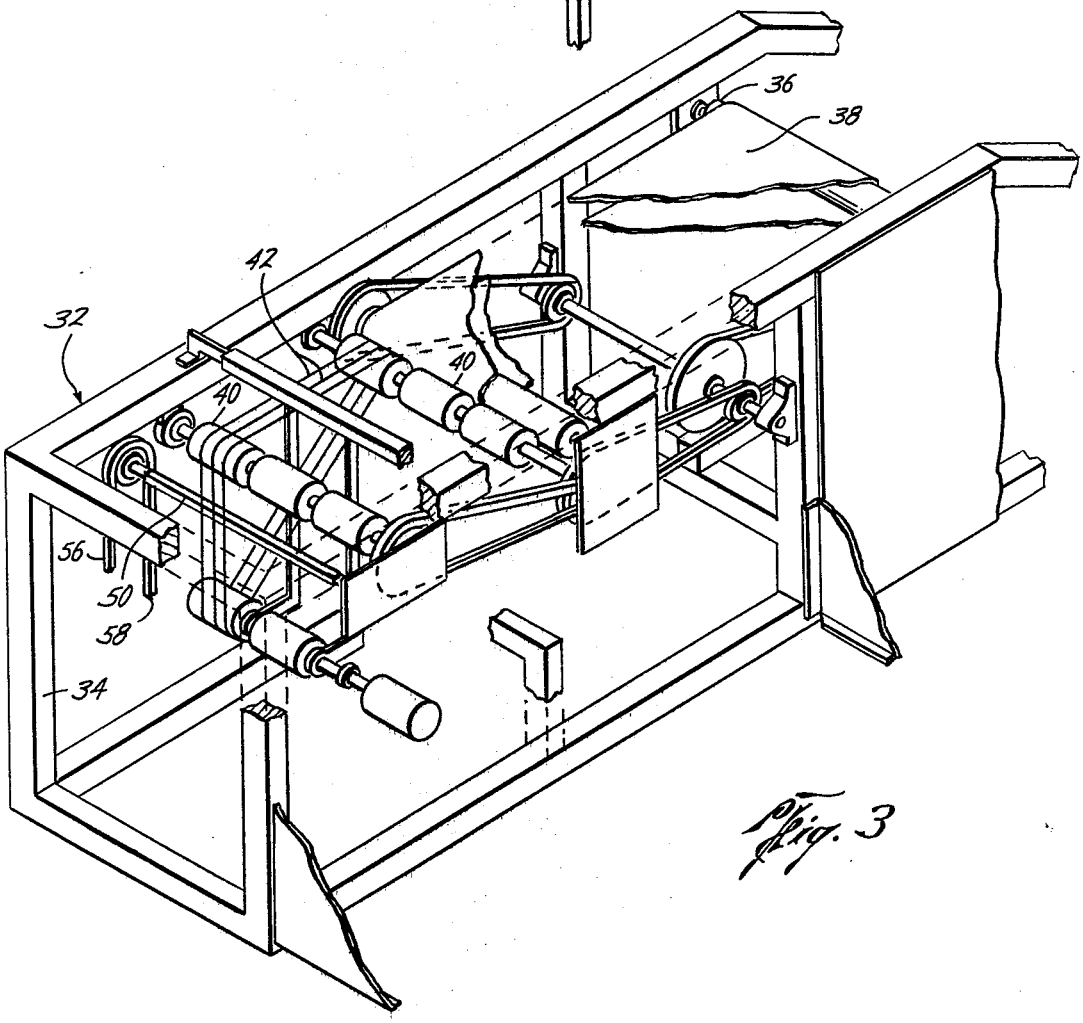
FIG. 3 is an enlarged perspective view of the carrying conveyor of the apparatus illustrated in FIG. 1.

As best seen in FIG. 3, second conveying portion 32 is constructed from a framework 34 that supports a motor (not shown) for rotating first pulley system 36 and belt 38 and driving second pulley system 40 and a multiplicity of O-ring belts 42. After the packages arrive from conveyor 18 they are moved through second conveying portion 32 to a discharge station 44 by means of belt 38 and O-ring belt 42. Preferably, belt 38 has a velocity of 350 feet per minute, while belt 42 has a velocity of 250 feet per minute. Accordingly, the packages travel at a faster speed along belt 38 than along belts 26 and 42.

Figure 4:
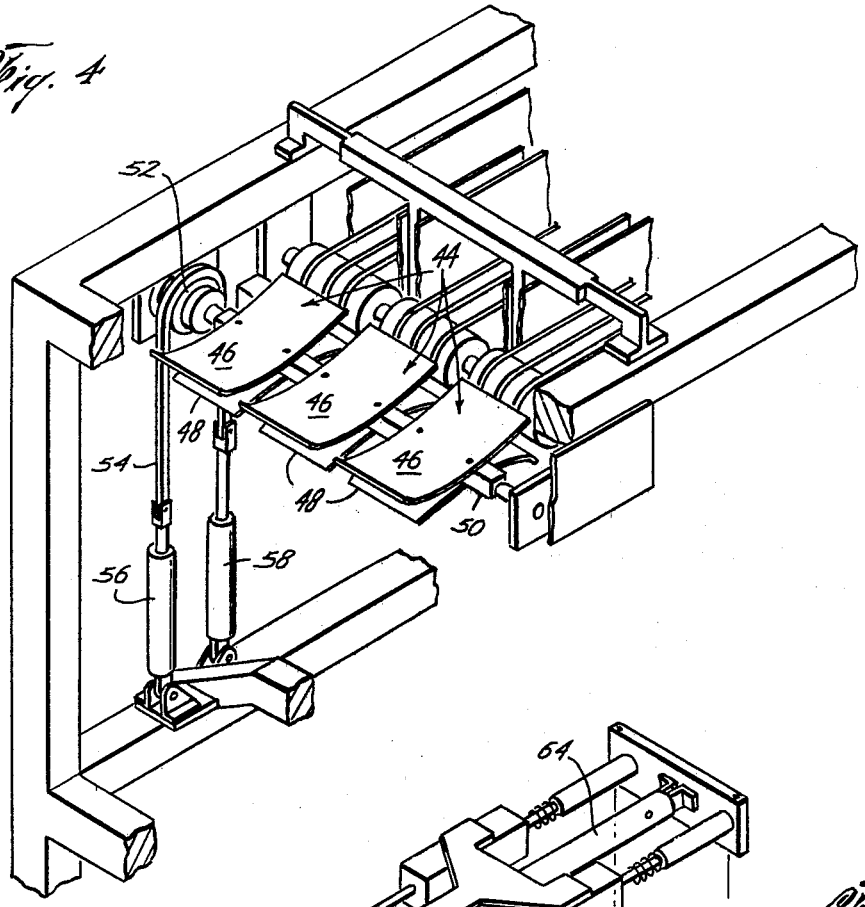
FIG. 4 is an enlarged perspective view of the discharge station of the apparatus illustrated in FIG. 1.

As shown in FIG. 4, the discharge apparatus includes support means having a first support surface 46 and a second support surface 48 on its side. The support surfaces are carried by a rod 50 extending transversely to the direction of movement provided by conveying means 18 and 32 and rotatable about its axis to flip first discharge surface 46 and second discharge surface 48 through substantially 180°. Preferably, rotating rod 50 is driven by a sprocket 52 attached to one end and a drive chain 54 is meshed with sprocket 52 with one end of the chain being attached to the rod of a first power piston 56 and the other end of the chain being attached to the rod of a second power piston 58.

As shown in FIG. 10, when piston 58 is activated by control means 16 to withdraw its piston, the support means is rotated 180° in a clockwise direction. The first package supported on surface 46 is thereby inverted and permitted to fall onto a stack site on the right side of the box as shown in dotted outline in FIG. 10. When piston 56 is activated by control means 16 to withdraw the piston the support means is rotated 180° in a counterclockwise direction. Thus, the second package supported on surface 48 is inverted and permitted to fall onto a stack site on the left side of the box, as shown in dotted outline in FIG. 11. This sequence is repeated in the preferred embodiment until such time as two stacks of three layers each are deposited in the box, as shown in FIG. 12.

Figure 5:
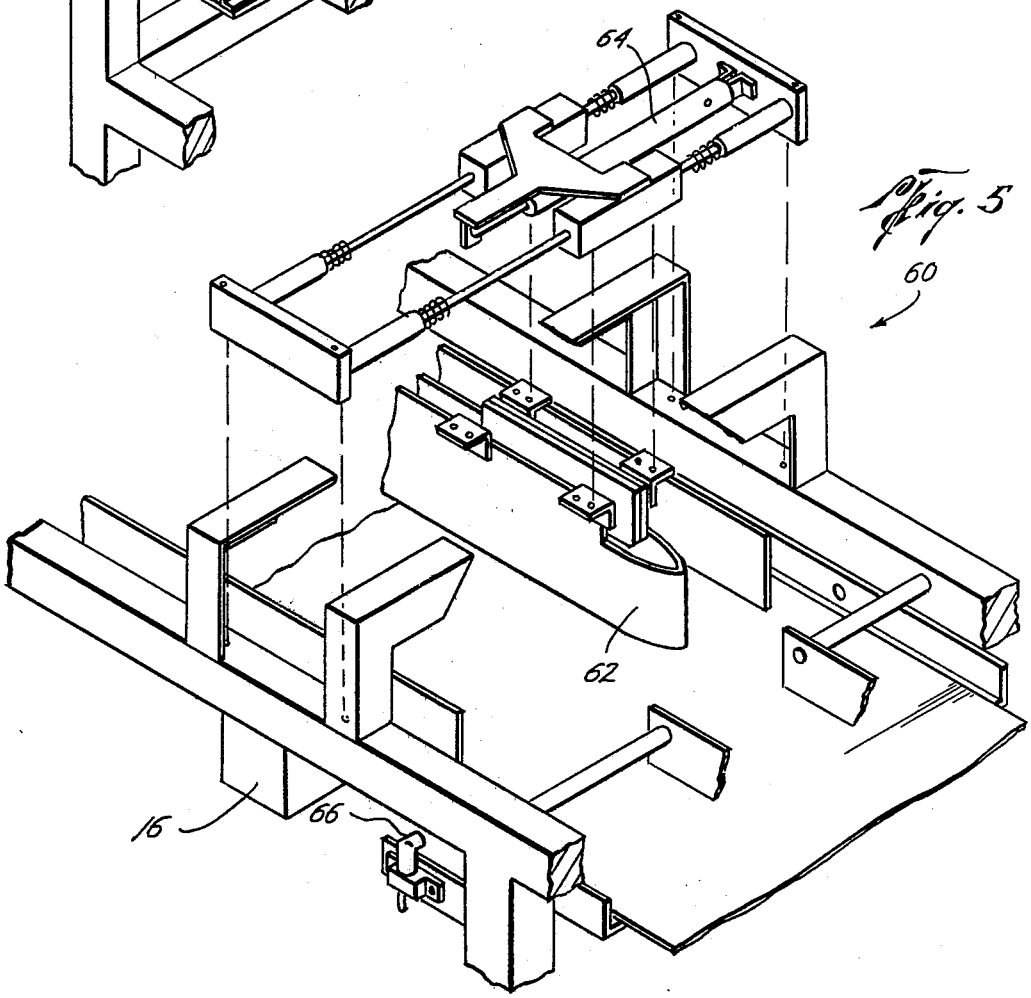
FIG. 5 is an enlarged perspective view of the shuttle mechanism of the apparatus illustrated in FIG. 1.

As shown in FIG. 5, when desired, a shuttling mechanism 60 may be used to selectively move the soft-pack goods from a first line of travel to two or more lines of travel. This is accomplished by using a paddle 62 attached to a power mechanism 64, preferably a pneumatic power piston, controlled by a control means 16 in response to electric eye 66. As packages break the beam of light going to electric eye 66, power mechanism 64 may be activated to move paddle 62, thus changing the line of travel of the soft-pack goods. Preferably, the soft-pack goods travel along three lines and paddle 62 is activated in response to the number of soft-pack goods breaking the beam of light. Thus, as shown in FIGS. 13–15, as a first package A breaks the beam of light, paddle 62 moves from the position illustrated in FIG. 13 to the position illustrated in FIG. 14, which moves package A to a first line of travel. As a second package B breaks the beam of light, paddle 62 is moved from the position illustrated in FIG. 14 to the position illustrated in FIG. 15 which moves package B into a second line of travel. As a third package C breaks the beam of light, paddle 62 remains stationary and package C moves along the third line of travel. Further, the passage of the third package through the light beam is used to activate power pistons 56 and 58 to cause the support means to flip through the 180° rotation.

When two or more lines of travel are used for moving packages of soft-pack goods to discharge station 44, a gate 68, such as illustrated in FIG. 6, is used to align the packages in side-by-side relation prior to entering station 44. Gate mechanism 68 uses relatively narrow members 70 having a flat portion 72 and an upwardly extending portion 74. Members 70 are attached to a rod 76 which is rotatably mounted within framework 34 of second conveying portion 32. A linkage mechanism 78 is connected to rod 76 at one end and to a pneumatically powered piston 80 at the other end. Preferably, two narrow members 70 are used for each gate 68 by being disposed between O-ring belts 42 of second conveying portion 32 with upwardly extending portion 74 restraining movement of the packages along the two outside lines of travel. Upon passage of a third package of soft-pack goods through the light beam passing to electric eye 66, power piston 80 moves linkage 78 and rod 76 to permit movement of the two restrained packages with the third package into each discharge station 44 for alignment of the three packages on the support surface and subsequent depositing within the selected box.

Moreover, a ram assembly 82, such as illustrated in FIG. 7, may be used to move boxes, as illustrated in dotted outline in FIGS. 1A and 1B, beneath each discharge station 44. Ram assembly 82 embodies a framework 84 supporting a power mechanism 86, preferably a pneumatic power piston, a ram 88 for engaging the empty boxes, and a conveyor 90 to position empty boxes in front of ram 88. To position empty boxes beneath the support means, the empty boxes are carried by conveyor 90 to a position in front of ram 88. Power mechanism 86 is activated to move ram 88, thus forcing an empty box into a position beneath discharge station 44. Preferably, ram 88 moves three elongated empty boxes at a time with the elongate axis of the boxes lying parallel to the line of travel of the packages under three discharge stations 44. It is for this reason that spacing members 92 are provided on ram assembly 82 to properly align an empty box for each discharge chute 44. Moreover, ram 86 is activated after a preset number of packages has broken the light beam passing to electric eye 66. Most preferably, ram 86 is activated when the 18th package has broken the light beam.

Figure 8:
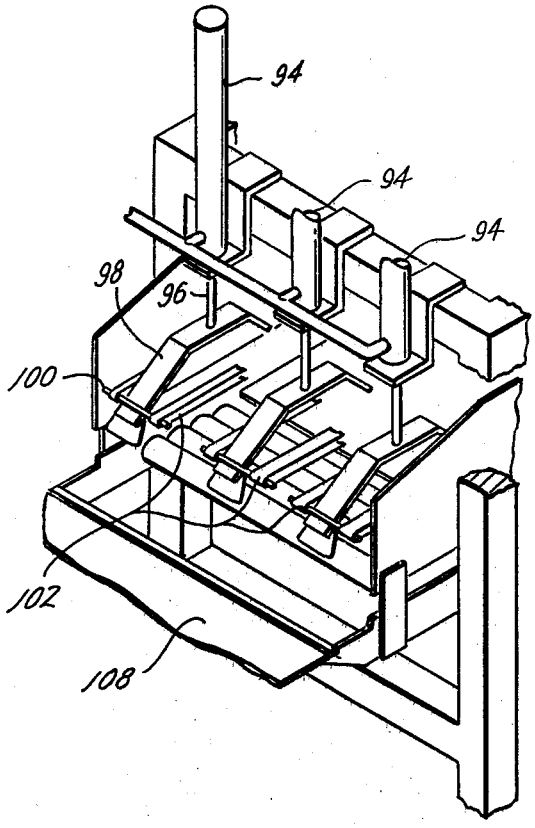
FIG. 8 is an enlarged perspective view of the dressing station of the apparatus illustrated in FIG. 1.

A dressing station 92 is provided for aligning packages of the soft-pack goods in each box. Although dressing station 92 may be used when filling single boxes, three dressing stations are illustrated in FIG. 8 because of the preferred embodiment using three discharge stations 44. Each dressing station 92 basically uses a power mechanism 94, preferably a pneumatic power piston, with a power ram 96 attached to a support member 98 holding an intermediate member 100 which supports resilient contacting members 102. Support member 98 and intermediate member 100 are of such length and width so as to fit within a box without causing significant damage to the soft-pack goods. Preferably, contact members 102 are rubber bands. The power mechanism 94 is activated in a manner similar to the activation of power mechanism 86 of ram assembly 82. Namely, as the final package necessary to fill all the boxes breaks the light beam of electric eye 66, power mechanism 94 is activated to dress the filled boxes which are disposed thereunder by the activation of ram assembly 82 moving empty boxes under the discharge station 44.

As the filled boxes leave each dressing station 92, the boxes are deposited on a conveying system for transporting to a machine for wrapping the boxes. An example of such a machine is basically constructed from a framework 104 supporting a packed box moving mechanism 106, a sliding table 108 and positioning mechanism 110. Preferably, packed box moving mechanism 106 is constructed similarly to dressing station 92. Namely, it has a power mechanism 112, a power ram 114 attached to a support member 116, an intermediate member 118 and contact members 120. Power mechanism 112 is supported by a 90° support elbow 112, which is powered by a mechanism (not shown) to move mechanism 112 through an arc. A linkage arm 124 is connected to support elbow 122 and extends to positioning mechanism 110. Positioning mechanism 110 includes a power mechanism 126, preferably pneumatically powered, having a power ram 128 attached to box contact member 130. Preferably, box contact member 130 has a flat portion 132 capable of extending across two boxes and downwardly extending portions 134 being of sufficient length to slidably move filled boxes across table 108 without touching table 108.

Figure 9:
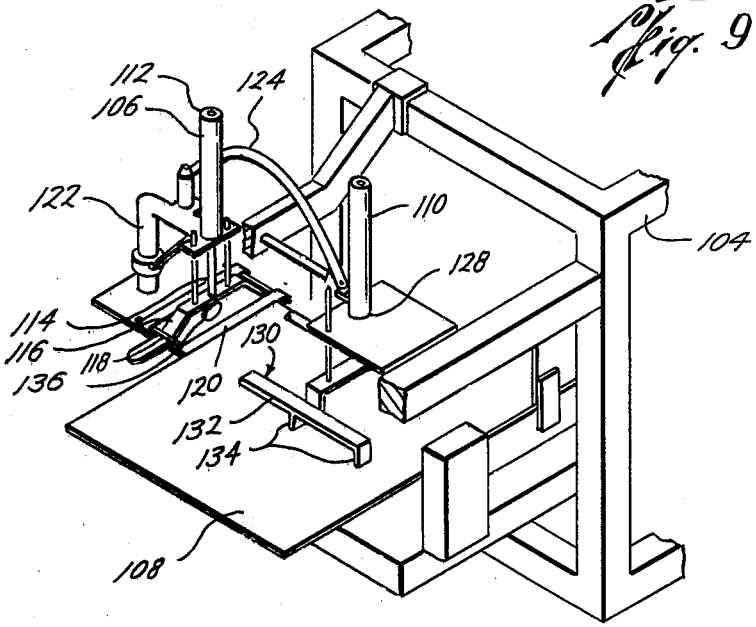
FIG. 9 is an enlarged perspective view of the box transfer station of the apparatus illustrated in FIG. 1.

An electric eye 136 is positioned along table 108 to indicate when filled boxes are disposed upon table 108 by breaking a light beam passing into electric eye 136. The breaking of this beam activates power mechanism 112 and 126. Contact members 120 and 130 move into contact with filled boxes. Support elbow 122 is rotated through a 90° arc, which moves the filled box under contact members 120 into alignment with a conveyor (now shown) for transporting to apparatus for wrapping the filled box. Linkage arm 124 pulls positioning mechanism 110 and any boxes under box contact members 130 into a position immediately below the original position of packed box moving mechanism 106. Power mechanisms 112 and 126 are then reversed to withdraw contact members 120 and 130 from contact with the packed boxes. Support elbow 122 is then rotated back to its original position, thereby returning packed box moving mechanism 106 and positioning mechanism 110 to the original positions shown in FIG. 9. This operation continues in sequence until such time as the light beam is received by electric eye 136 to indicate no boxes remain on table 108.

To review the overall operation, the packages of soft-pack goods are carried in a single line to conveyor 32 by conveyor 18, the first package breaks the light beam to electric eye 66 to cause paddle 62 of shuttle mechanism 60 to move the package into a first line of travel for retention by a first gate 68. As the second package breaks the light beam, paddle 62 is activated to removed this package into the second line of travel for retention by a second gate 68. As the third package breaks the light beam, paddle 62 remains stationary permitting travel along a third line. Also, this third breaking of the light beam causes first and second gates 68 to open and activate power piston 56 or 58 to flip the support means through 180° about the axis of rotation of rod 50, and thereby invert and stack the packages in one of the two stack sites. The shuttling of the packages and flipping action is repeated until eighteen packages have broken the light beam to electric eye 66, and thus three boxes have been filled with six packages each. The filled boxes are replaced with empty boxes, which are moved on conveyor 90 to ram assembly 82 for positioning in front of ram 88. Ram 88 is also activated when 18 packages have broken the light beam to electric eye 66. The pushing of the empty boxes beneath the support means forces the filled boxes to beneath the three dressing stations. After 18 more packages have broken the light beam, further actuation of ram 88 forces the dressed boxes onto sliding table 108, which moves away from the dressing stations for approximately 2 inches. The light beam passing to electric eye 136 is broken and moving mechanism 106 activated for moving the boxes onto a conveyor while turning the box 90° to the line of travel of conveyor 32.

Thus, it is apparent that there has been provided, in accordance with the invention, a boxing apparatus that fully satisfied the objects, aims, and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the claims.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A method for depositing packages of soft packed goods in a box, comprising the steps of moving the packages facing up or down, singly receiving successive ones of the packages on a support means, alternately rotating said support means approximately 180° in opposite rotative directions when successive packages are received thereon so as to invert and permit alternate ones of said packages to fall onto two respective stack sites in the box, and continuing to singly receive successive ones of the packages on the support means and alternately rotating support means in opposite directions in order to invert and stack additional packages one above the other at each stack site.

2. The method of claim 1, including the further step of shifting one package of the first-mentioned line of movement laterally into a second line of movement and braking the movement of the one package until a successive package in the first-mentioned line has moved into a position to one side of the one package, successive side-by-side packages in the two lines being singly received by the support means so that two stacks of packages may be simultaneously deposited into each side-by-side box positioned beneath the support means.

3. The method of claim 1, including the step of moving empty boxes in a line transverse to the line of successive packages so as to sequentially dispose successive boxes on one side of the box to be filled, and pushing the unfilled box when so disposed into a filling position beneath the support means, the unfilled box engaging the filled box to move it to a position in which the packages stacked therein may be dressed, and including the step of dressing the packages in a filled box when disposed in position for dressing, the dressed box being engaged by the filled box to move it to another station as the filled box is moved by the empty box into a position for dressing.

4. A method for depositing packages of soft packed goods in a box, comprising the steps of moving the packages facing up or down, singly receiving successive ones of the packages on a support means, and alternately rotating said support means approximately 180° about an axis transverse to the line of movement of the packages and in opposite rotative directions when successive packages are received thereon so as to invert and permit alternate ones of said packages to fall onto two respective stack sites in the box.

5. An apparatus for depositing packages of soft-pack goods in a box, comprising conveying means for moving the packages in a line of successive packages facing up or down, support means for singly receiving successive ones of said packages from the conveying means, and means for rotating said support means approximately 180° in one direction, when a first package is received thereon; thereby inverting said first package and permitting it to fall onto one stack site in a box beneath the support means, and for rotating said support means approximately 180° in the opposite direction, when a second package is received on said support means, thereby inverting said second package and permitting it to fall into another stack site in the box, said rotating means including means for rotating the support means about an axis transverse to the line of movement of said packages.

6. The apparatus of claim 5, including means for shifting one package of said single line laterally into a second line, and means for braking the movement of said one package on said conveying means until a successive package in said first-mentioned line of packages has moved into a lateral position with respect to the one package, said support means including means for singly receiving successive side-by-side packages in said first-mentioned and additional lines, whereby two stacks of packages may be simultaneously deposited into each of side-by-side boxes beneath the support means.

7. The apparatus of claim 6, wherein said shifting means comprises a paddle shiftable laterally of the conveying means between first and second positions on opposite sides of said first-mentioned line, and means for moving the paddle from its first position to its second position to shift one package into one side line as one package moves into a position laterally opposite the paddle, and then from its second to its first position to shift a successive package into the other side line as said successive package moves into a position laterally opposite the paddle, said braking means including means to oppose said movement of said one and successive packages on the conveying means until a third package in said one line moves into a position laterally therebetween.

8. The apparatus of claim 5, including means for mounting an empty box beneath the support means, conveying means for moving empty boxes in a line transverse to the line of successive packages so as to sequentially dispose successive boxes on one side of said mounting means, an actuator for moving the so disposed box onto the mounting means, and means for mounting a filled box on the other side of the empty box mounting means, and means vertically reciprocable above the mounting filled box means for dressing the packages stacked therein, each filled box being moved from the empty box mounting means to the filled box mounting means by engagement therewith of an empty box being moved onto the empty box mounting means by said actuator.

9. The apparatus of claim 8, including a further means for mounting a dressed box on the side of the filled box mounting means opposite the first mounting means, and means for removing said dressed box from said further mounting means to a station at which the dressed box is to be wrapped, each dressed box being moved from the dressed box mounting means to said further mounting means by engagement therewith of a filled box being moved onto said dressed box mounting means.

* * * * *